United States Patent [19]

Karpp

[11] 4,089,111

[45] May 16, 1978

[54] UTILITY TOOL

[76] Inventor: Heinrich Karpp, Fahrenberg 19 A, 4300 Essen, Germany

[21] Appl. No.: 744,605

[22] Filed: Nov. 24, 1976

[30] Foreign Application Priority Data

Nov. 26, 1975 Germany ..... 2553013

[51] Int. Cl.[2] ..... B26B 1/00

[52] U.S. Cl. ..... 30/154; 30/169

[58] Field of Search ..... 30/2, 154, 155, 162, 30/169

[56] References Cited

U.S. PATENT DOCUMENTS

| | | | |
|---|---|---|---|
| 2,107,736 | 2/1938 | Huber | 30/2 |
| 2,257,314 | 9/1941 | Shinn | 30/169 |
| 3,518,758 | 7/1970 | Bennett | 30/154 |

FOREIGN PATENT DOCUMENTS

| | | | |
|---|---|---|---|
| 1,020,485 | 2/1966 | United Kingdom | 30/169 |

*Primary Examiner*—Robert C. Watson
*Attorney, Agent, or Firm*—Michael J. Striker

[57] ABSTRACT

A utility tool, such as a scraper, trimmer, cutter and the like, has a tool element and an elongated handle element, the tool element being mounted on the handle element for movement between an extended position in which a working edge portion of the tool element assumes a working position outside the handle element, and a retracted position in which the tool element is accommodated in an internal cavity of the handle portion. The handle element has a cam track, such as a guide slot, and the tool element has a follower pin which guides the tool element during its movement between the two positions thereof. The guide slot has two sections which enclose an angle with one another, one of the sections extending along the front end of the handle element, and the other section extending along a longitudinal marginal portion of the handle element. The front end of the handle element and the associated cam track section enclose an acute angle with the elongation of the handle element. A depression is formed at the front end of the handle element for accommodating a portion of the tool element in the extended position thereof. A socket hole is provided at the rear end of the handle element and communicates with the cavity, being adapted to receive an end of an extension rod. In the retracted position, a part of the tool element may be accommodated in the socket hole. An arrangement may be provided for arresting said tool element in said extended and retracted positions.

18 Claims, 5 Drawing Figures

UTILITY TOOL

BACKGROUND OF THE INVENTION

The present invention relates to a utility tool in general, and more particularly to a scraping tool for removing adhering contaminants from, for instance, window panes, floors, walls and the like.

There is already known a wide variety of different utility tools, such as scrapers, trimmers, cutters, utility knives, and the like. Usually, such tools include a respective tool element and a handle element. In some instances, the tool element is mounted on the handle element for movement relative thereto. It is also already known to construct the tool element in two parts, namely a tool holder, and the tool proper, such as a blade or the like.

In many instances, these tools are to be used by a user who stands on a ladder. Thus, there exists the need to develop a utility tool which can be handled and adjusted by the user while using only one hand for such use or adjustment. This is also valid for such tools, which are much in demand nowadays, in which the tool element is retractable into the interior of the handle element, so as to hide a cutting or other working edge of the tool element and thus protect the user of the utility tool from possible injury. Even the adjustment of the position of the cutting element relative to the handle element should be accomplished in one-hand operation.

There is already known a scraping tool which satisfies the above-outlined requirements. This utility tool is disclosed in the U.S. Pat. No. 2,291,514 in which a blade is supported on a blade mount. The blade mount with the blade are mounted in a flat handle housing for displacement longitudinally thereof. In one end position thereof, the blade mount with the blade are in their extended working position, while the blade is located in the interior of the handle housing in the other end position. The adjustment of the position of the blade mount-blade assembly relative to the handle housing is accomplished by means of an outwardly projecting bulge.

However, this mount arrangement has an important drawback in that the manufacturing and assembling costs are relatively high. In addition thereto, it is very difficult to remove impurities which may have clogged the mouth through which the tool is to extend to the exterior of the handle housing or which may have penetrated into the interior of the housing. A further disadvantage thereof is that it cannot be mounted on a telescopic extension rod, which is sometimes necessary in order to be able to perform large-area scraping or similar operations.

SUMMARY OF THE INVENTION

Accordingly, it is a general object of the present invention to avoid the above-mentioned disadvantages.

More particularly, it is an object of the present invention to provide a scraping tool or the like which is simple in construction, inexpensive to manufacture and assemble, and reliable in operation.

A concomitant object of the present invention is to provide a utility tool of this type which is adjustable between a retracted position in which the tool element is located inside the handle, and an extended working position, in a one-hand operation.

It is still another object of the present invention to provide a utility tool which can be readily and quickly cleaned of impurities.

In pursuance of these objects and others which will become apparent hereafter, one feature of the present invention resides, briefly stated, in a utility tool, such as a scraper, trimmer, cutter and the like, which comprises a tool element having a working edge portion, an elongated handle element having a front and a rear end and bounding a cavity which has a mouth at said front end and such dimensions as to fully accommodate such tool element; and means for mounting said tool element on said handle element for movement between an extended position in which a working edge portion assumes a working position on said handle element and a storage position in which said tool element is received in said cavity, said mounting means comprising a cam track on one of said elements and a follower on the other element and engaging said cam track to guide the two elements for said movement between said positions thereof. Advantageously, said cam track is a guide slot in said one element and said follower is a guide pin rigidly connected to said other element. Preferably, the handle element includes two housing sections or shells which abut one another at a central longitudinal plane. Then, the above-mentioned guide slot can be provided in either one of the housing sections, or even in both of them in alignment with one another.

The cam track or guide slot may have a first section which guides said tool element between said extended and an intermediate position in which said tool element can be rotated about said follower, and a second section enclosing an angle with said first section and operative for guiding said tool element between said intermediate and said retracted position.

When the utility tool is constructed as previously discussed, there is obtained a very compact housing, in which the tool holder and the blade supported therein, which together constitute the tool element, conduct combined sliding and pivoting motions during the movement between the two end positions thereof. The guide pin may extend outwardly beyond the handle element to the exterior thereof, so that it can be acted upon by the user of the pivoted tool. Thus, for instance, the user can exert force on the outwardly extending portion of the guide pin and displace the same along the cam track between the above-mentioned two end positions. However, it is also possible to utilize the weight of the tool element itself, such as by displacing the center of gravity thereof, for instance by tilting the handle element in space. Under these circumstances, it is not necessary to exert any force on the projecting portion of the guide pin. When the tool holder is accommodated in the cavity of the handle element, the longitudinal axis of the former encloses a small acute angle with the central longitudinal axis of the latter.

The scraper which is constructed in the above-discussed manner is especially easy and safe to operate, in that the working edge of the tool element is exposed only in the extended position of the tool element, while the working edge is hidden in the cavity of the handle element when the utility tool is not being used, so that the utility tool can be put into the pocket of a garment of the user without any qualms in that no danger of injury exists. The manufacture and assembly, as well as disassembly for cleaning purposes, are very simple in that the entire utility tool consists of only a few parts, that is the two sections of the handle element, the tool holder with the blade mounted thereon, and the guide pin mounted on the tool holder.

The handle element is preferably provided with a socket hole at the rear end thereof for insertion of an extension rod therein. The socket hole may be cylindrical or conical. The whole utility tool, as a consequence, is extremely handy and compact.

The socket hole may be a blind hole, but preferably it communicates with the cavity and forms an extension thereof. Under these circumstances, the tool element can also be partly received in such socket hole, in addition to being accommodated in the cavity, when in the retracted position thereof. Thus, the length of the handle element can be kept to a minimum.

However, when this expedient is used, there comes into existence the danger that the user of the tool may, for one reason or other, insert a finger into the socket hole when the tool element is in its retracted position, and thus suffer injury as a result of contact of such finger with the working edge which is accessibly situated in said socket hole.

To avoid this possibility of injury, the present invention further proposes to provide two diametrically opposite recesses extending along the socket hole in said handle element, one of them for receiving an abutment portion of the tool element which is situated opposite to the working edge, and the other for receiving the working edge proper, in the retracted position of the tool element.

To assure that the working edge will be kept out of the socket hole, the handle element is provided with an abutment projection which comes into contact with the abutment portion of the tool element as the same moves toward the retracted position thereof. The abutment projection is so shaped and so cooperates with said abutment portion that said tool element moves in such a way toward the retracted position thereof that the abutment portion enters said one recess and the working edge is located entirely outside the socket hole, that is, partially in the cavity and partially in said other recess, and retained in the latter by the cooperation of said abutment projection and said abutment portion.

The handle element has a longitudinal marginal portion which extends between said ends of said handle element, and said first section extends along said front end and said second section extends along said marginal portion. The handle element also has another longitudinal marginal portion which also extends between said ends. The front end of the handle element encloses an acute angle with the elongation of said handle element so that one of said marginal portions is longer than the other one. As a result of the inclination of the front end of the handle element, the cleaning action is improved.

The two sections of the cam track or guide slot have different lengths, which renders it possible to perform the combined pivoting and shifting movement of the tool holder in an optimum manner. Preferably, the longer marginal portion merges with said front end at a corner, and said sections of said cam track meet at said corner. Then, said first section extends substantially parallel to said front end and with a spacing therefrom, and said second section extends substantially parallel to said marginal portion which has the greater length and at a distance therefrom. When the handle element is constructed in this manner, it is possible to achieve an easy and quick shifting and pivoting of the tool holder between the two end positions thereof.

According to a further concept of the present invention, said handle element has at least one depression in said front end thereof in which said abutment edge is received and abuts said handle element when said tool element assumes said extended position thereof. Preferably, the two housing sections of said handle element together bound said cavity and also said depression. The tool element is then reliably retained in its working position.

The utility tool of the present invention may further comprise means for arresting said tool element in at least one of said positions thereof. Such arresting means may include bulges, cutouts and similar arrangements. In this manner, an unintentional displacement of the guide pin in the guide slot or along the guide track from one of the end positions toward the other end position is avoided.

When the cam track is a guide slot in the handle element, and said follower is a guide pin rigidly connected to the tool element and having a portion which projects beyond the latter, as currently preferred, the arresting means may include an external thread at least on the above-mentioned projecting portion of the pin, and a nut having an internal thread engaging the external thread of the pin to clamp a zone of said handle element, which surrounds the guide slot in the respective position of the pin relative to the guide slot, between itself and the tool element to thereby frictionally retain the tool element in the then attained position.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
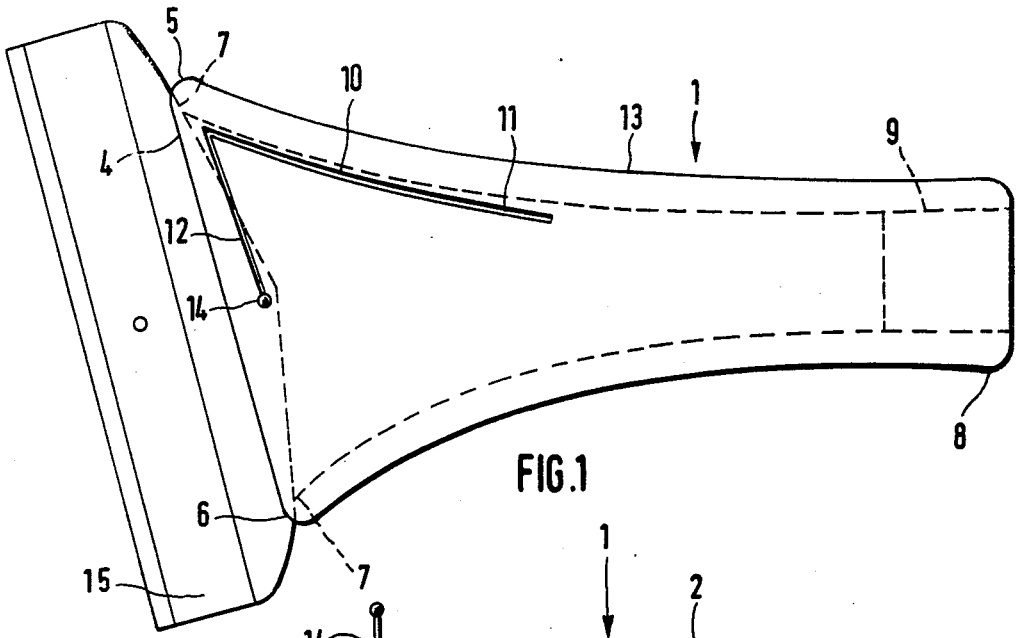
FIG. 1 is a top plan view of a utility tool according to the present invention, with the tool element in its extended working position.

Referring now to the drawing in detail, and first to FIG. 1 thereof, it may be seen that the reference numeral 1 has been used to designate a handle element in toto. The handle element 1 includes an upper housing section 2 and a lower housing section 3 when considered in the position illustrated in the drawing. The handle element 1 has a front end 4 which extends at an acute angle to the elongation of the handle element 1, so that a corner region 5 of the front end 4 extends farther than the corner region 6 of the front end 4. The housing sections 2 and 3 of the handle element 1 are provided with offset regions 7 at the front end 4 of the handle element 1, which together bound a depression and a cavity which extends over most of the lengths of the housing sections 2, 3 of the handle element 1 toward the rear end 8 of the latter. A socket hole 9 is provided at the rear end 8, and a telescopic extension rod may be inserted or plugged into the socket hole 9 for mounting the utility tool on such a telescopic rod.

A basically V-shaped guide track 10, such as a guide slot, is provided either in the upper housing section 2, or in the lower housing section 3, or in both, of the handle element 1. The cam track 10 has two arms 11 and 12, the arm 11 being longer than the arm 12. The point at which the arms or cam track sections 11 and 12 meet is located at the corner region 5. The longer cam track section 11 extends approximately parallel to a marginal portion 13 of the handle element 1 and with a small spacing therefrom, while the shorter cam track section 12 extends approximately parallel to the front end 4 of the handle element 1 at a small distance therefrom.

A guide pin 14 is in contact with the cam track 10 such as, when the cam track is constructed as a guide slot, by being received within such slot. The pin 14, which acts as a cam follower, is connected to a tool holder 15, in which there is mounted, or on which there is supported, in a conventional manner, a blade or a similar tool.

Figure 2:
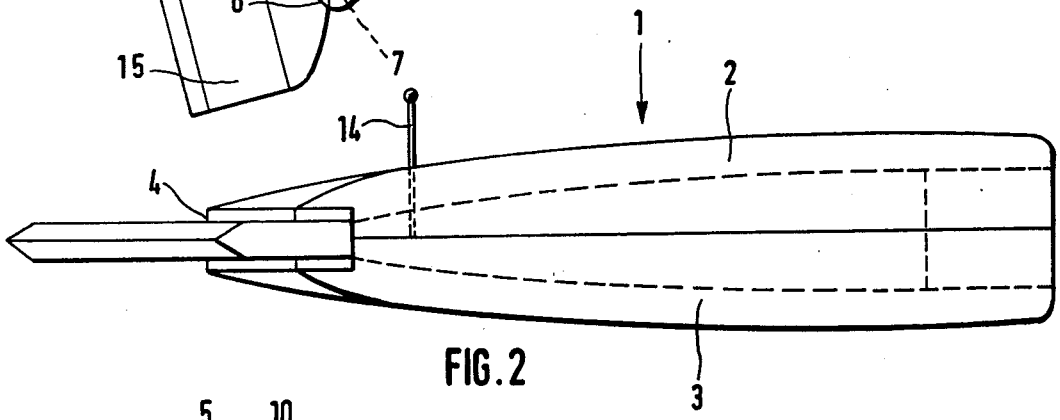
FIG. 2 is a side elevational view of FIG. 1.

As particularly seen in FIGS. 1 and 2, the tool holder 15, when in its extended working position which is illustrated in these Figures, abuts at its abutment region against the handle element 1 within the depressions 7, so that the tool holder 15 is securely supported in this position. In this extended position of the tool element, the guide pin 14 is located in the end position at the free end of the cam track section 12. When the guide pin 14 is shifted in direction toward the intermediate position, that is, toward the point where the sections 11 and 12 of the cam track 10 meet, the tool holder 15 is moved in direction toward the corner 5, while it is simultaneously pivoted about the pin 14. Upon reaching the intermediate position, the trailing end of the tool holder 15 can be pivoted into the mouth and the cavity between the housing sections 2 and 3. Now, when the guide pin 14 is displaced through the cam track section 11, the tool holder 15 will be displaced in the longitudinal direction thereof, while conducting a further slight pivoting movement about the guide pin 14, until the guide pin 14 reaches the end of the section 11 of the cam track 10. When this happens, as illustrated in FIG. 3, the tool holder 15 and the non-illustrated conventional blade mounted therein or thereon, are fully retracted into the internal cavity of the handle element 1 so that the possibility of injury to the user of the utility tool is eliminated.

The utility tool constructed according to the present invention is very compact and extremely handy. It is possible to move the tool holder 15 with the blade therein between the extended working position and the retracted protected position, and vice versa, in a one-hand operation. The two housing sections 2 and 3 are connected to one another by non-illustrating conventional screws so that, when such screws are loosened and removed, the housing sections 2 and 3 can be separated to provide access to the interior and particularly to the cavity thereof, so that such interior can be easily cleaned and all impurities which may have penetrated thereinto can be rapidly removed and the housing sections 2 and 3 can then be reassembled with one another and with the tool holder 15 and the guide pin 14 thereof.

Figure 3:
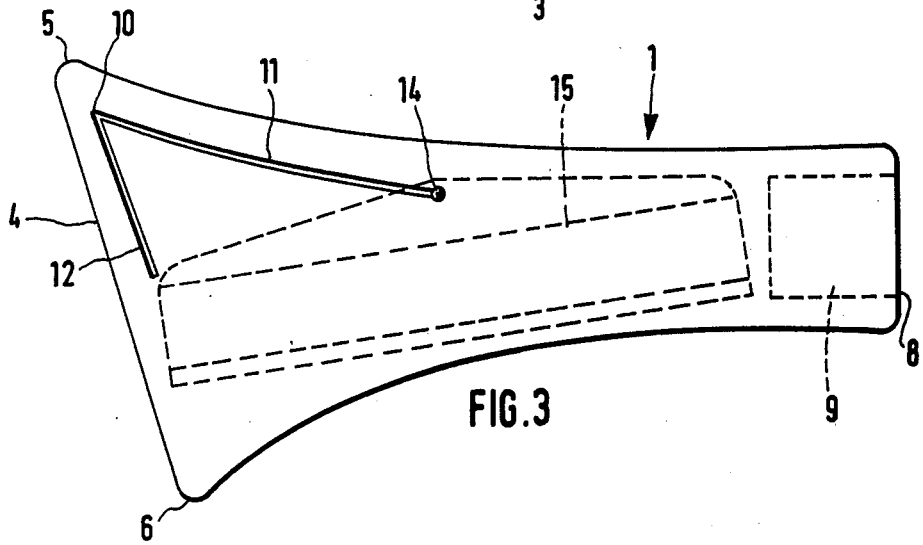
FIG. 3 is a view similar to FIG. 1 but with the tool element in its retracted concealed position.
Figure 4:
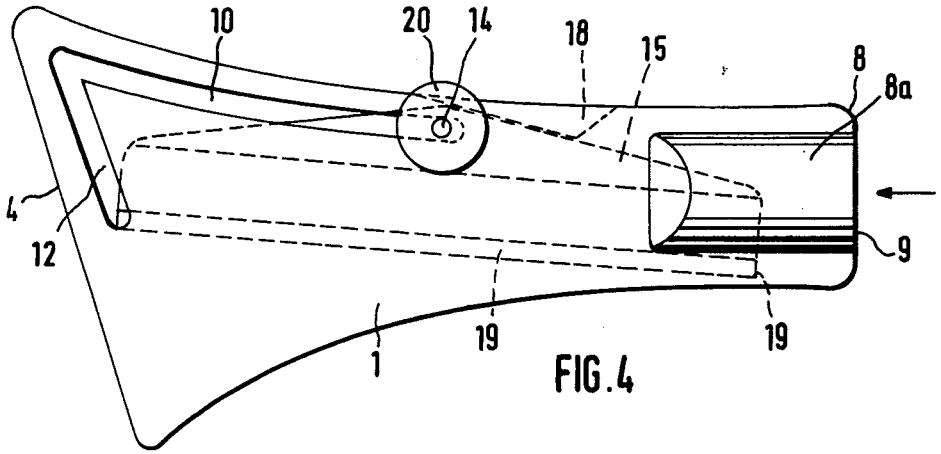
FIG. 4 is a view similar to FIG. 3 but of a modified tool of the present invention.
Figure 5:
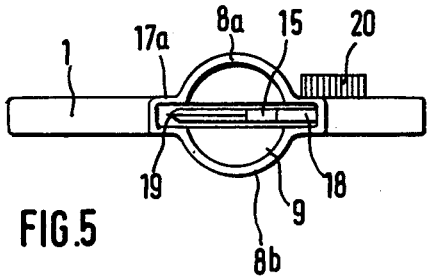
FIG. 5 is a rear end view of the modified tool of the invention taken in direction of the arrow V of FIG. 4.

Referring now to FIGS. 4 and 5 which illustrate a modified version of the tool of the present invention, it will be realized that most of the components are common to this modification and the basic tool of FIGS. 1 to 3, so that the same reference numerals have been used in all Figures to indicate structurally and functionally similar parts. It will be appreciated that the expedients which will be discussed presently could also be used in the embodiment of FIGS. 1 to 3.

As illustrated particularly in FIG. 5, the handle element 1, unlike that illustrated in FIGS. 1 to 4, is flat and is formed at its rear end 8 with hollow bulges **8*a* and 8*b* which together bound the socket hole 9. The socket hole 9** communicates with the above-discussed cavity and forms an extension thereof.

The tool element 15 contains a blade 19. When the tool element 15 is in its illustrated retracted position, it is partly received in the socket hole 9. Thus, were it not for the expedients which will be currently discussed, if the user of the tool reached into the socket hole 9 when the tool element 15 is retracted, there would exist the possibility that he could injure his finger by contacting the working edge of the blade 19.

To avoid this possibility, it is further proposed by the invention to form the handle element with two recesses **17*a* and 17*b* which are opposite one another and extend along the socket hole 9. As the tool element 15 approaches its retracted position, the leading end of the abutment portion enters the recess 17*b* and, simultaneously therewith, the blade 19 enters the recess 17*a*. However, if the tool element were free to conduct pivotal movements when close to and in the retracted position, it could still assume a position within the socket hole 9 in which the blade 19 would be exposed in the socket hole 9. To avoid this possibility, the handle element 1 is formed with an abutment projection 18 which guides the tool element 15 toward the illustrated retracted position thereof and maintains the same in such position, preventing pivoting thereof. As a consequence of this, the blade 19 can never enter the socket hole 9** so that the above-mentioned possibility of injury is non-existent.

FIGS. 3 and 4 also illustrate that the means for arresting the tool element 15 in the retracted and/or extended position thereof may include a nut 20 which is threaded onto an externally threaded portion of the pin 14. The nut 20 and the tool element 15 then frictionally engage between themselves a zone of the handle element which surrounds the guide slot 10 at the pin 14 and thus retain the tool element 15 in any particular position thereof. As an alternative, the pin 14 may be rigid with the member 20, and an internally threaded bore may be provided in the tool element 15.

It will be understood that each of the elements described above, or two or more together, may also find a useful application in other types of constructions differing from the types described above.

While the invention has been illustrated and described as embodied in a scraping tool, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A utility tool, such as a scraper, trimmer, cutter and the like, comprising a tool element having a working edge portion; an elongated handle element having a front and a rear end and a longitudinal marginal portion extending between said ends of said handle element, and bounding a cavity which has a mouth at said front end and such dimensions as to fully accommodate said tool element; and means for mounting said tool element on said handle element for movement between an extended position in which said working edge portion assumes a working position outside said handle element, and a retracted storage position in which said tool element is received in said cavity, said mounting means including a cam track on said handle element and a follower on said tool element and engaging said cam track to guide said tool element for said movement between said positions thereof, said cam track having a first section extending along said front end and operative for guiding said tool element between said extended and an intermediate position in which said tool element can be rotated about said follower, and a second section enclosing an angle with said first section and extending along said marginal portion and operative for guiding said tool element between said intermediate and said retracted position.

2. A tool as defined in claim 1, wherein said handle element has another longitudinal marginal portion also extending between said ends; and wherein said front end of said handle element encloses an acute angle with the elongation of said handle element so that one of said marginal portions is longer than the other one.

3. A tool as defined in claim 2, wherein said one marginal portion merges with said front end at a corner; and wherein said sections of said track meet at said corner.

4. A tool as defined in claim 1, wherein said first section extends substantially parallel to said front end and with a spacing therefrom.

5. A tool as defined in claim 1, wherein said second section extends substantially parallel to said marginal portion at a distance therefrom.

6. A utility tool, such as a scraper, trimmer, cutter and the like, comprising a tool element having a working edge portion; an elongated handle element having a front and a rear end and bounding a cavity which has a mouth at said front end and such dimensions as to accommodate said tool element, and a socket hole at said rear end for insertion of an extension rod thereinto and said socket hole communicating with said cavity to form an extension thereof in which a portion of said tool element is received in said retracted position thereof; and means for mounting said tool element on said handle element for movement between an extended position in which said working edge portion assumes a working position outside said handle element, and a retracted storage position in which a portion of said tool element is received in said socket hole and the remainder in said cavity, said mounting means including a cam track on one of said elements and a follower on the other element and engaging said cam track to guide said tool element for said movement between said positions thereof.

7. A utility tool, such as a scraper, trimmer, cutter and the like, comprising a tool element having a working edge portion and an abutment portion opposite to said working edge portion; an elongated handle element having a front and a rear end and bounding a cavity which has a mouth at said front end and such dimensions as to fully accommodate said tool element, and a socket hole at said rear end for insertion of an extension rod thereinto; and means for mounting said tool element on said handle element for movement between an extended position in which said working edge portion assumes a working position outside said handle element, and a retracted storage position in which said tool element is received in said cavity, said mounting means including a cam track on one of said elements and a follower on the other element and engaging said cam track to guide said tool element for said movement between said positions thereof, and said handle element having two diametrally opposite recesses extending along said socket hole and receiving said working edge and said abutment portion, respectively, in said retracted position of said tool element.

8. A tool as defined in claim 7, wherein said handle element has an abutment projection contacting said abutment portion of said tool element as the same moves toward said retracted position thereof to so guide said tool element that said abutment portion enters one of said recesses and said working edge is located entirely outside said socket hole and partially within the other recess and retained therein by the cooperation of said abutment projection with said abutment portion in said retracted position of said tool element.

9. A utility tool, such as a scraper, trimmer, cutter and the like, comprising a tool element having a working edge portion; an elongated handle element having a front and a rear end and bounding a cavity which has a mouth at said front end and such dimensions as to fully accommodate said tool element; and means for mounting said tool element on said handle element for movement between an extended position in which said working edge portion assumes a working position outside said handle element, and a retracted storage position in which said tool element is received in said cavity, said mounting means including a cam track on one of said elements and a follower on the other element and engaging said cam track to guide said tool element for said movement between said positions thereof, said cam track being substantially V-shaped having a first section for guiding said tool element between said extended and an intermediate position, and a second section enclosing an angle with said first section and operative for guiding said tool element between said intermediate and said retracted position.

10. A tool as defined in claim 9, wherein said sections have different lengths.

11. A tool as defined in claim 9, and further comprising means for arresting said tool element in at least one of said positions thereof.

12. A tool as defined in claim 11, wherein said cam track is a guide slot in said handle element and said follower is a guide pin rigidly connected to said tool element and having a portion which projects beyond the latter; and wherein said arresting means includes an external thread at least on said projecting portion of said pin, and a nut having an internal thread engaging said external thread to clamp a zone of said handle element surrounding said guide slot between itself and said tool element.

13. A tool as defined in claim 9, wherein said handle element has a socket hole at said rear end for insertion of an extension rod thereinto.

14. A tool as defined in claim 9, wherein said cam track is a guide slot in said one element and said follower is a guide pin rigidly connected to said other element.

15. A tool as defined in claim 13, wherein said socket hole is cylindrical.

16. A tool as defined in claim 13, wherein said socket hole is conical.

17. A tool as defined in claim 9, wherein said tool element has an abutment portion opposite said working edge portion; and wherein said handle element has at least one depression at said mouth thereof, in which said abutment portion is received to abut said handle element thereat when said tool element assumes said extended position thereof.

18. A tool as defined in claim 17, wherein said handle element includes two housing sections which abut one another at a central longitudinal plane; and wherein said housing sections together bound said cavity and said depression.

* * * * *